US011830331B2

(12) United States Patent
Doyle

(10) Patent No.: US 11,830,331 B2
(45) Date of Patent: Nov. 28, 2023

(54) SECURED CONTAINER FOR STORING A PACKAGE

(71) Applicant: PELIPOD LTD, London (GB)

(72) Inventor: Jonathan Doyle, London (GB)

(73) Assignee: PELIPOD LTD, London (GB)

( * ) Notice: Subject to any disclaimer, the term of this patent is extended or adjusted under 35 U.S.C. 154(b) by 6 days.

(21) Appl. No.: 17/598,815

(22) PCT Filed: Mar. 17, 2020

(86) PCT No.: PCT/EP2020/057212
§ 371 (c)(1),
(2) Date: Sep. 27, 2021

(87) PCT Pub. No.: WO2020/193270
PCT Pub. Date: Oct. 1, 2020

(65) Prior Publication Data

US 2022/0189263 A1 Jun. 16, 2022

(30) Foreign Application Priority Data

Mar. 28, 2019 (EP) ..... 19165984

(51) Int. Cl.
*G08B 13/06* (2006.01)
*G08B 25/10* (2006.01)
*G07C 9/00* (2020.01)

(52) U.S. Cl.
CPC ..... *G08B 13/06* (2013.01); *G07C 9/00896* (2013.01); *G08B 25/10* (2013.01)

(58) Field of Classification Search
CPC .... G08B 13/06; G08B 25/10; G07C 9/00896; E05G 1/10
See application file for complete search history.

(56) References Cited

U.S. PATENT DOCUMENTS

| | | | | |
|---|---|---|---|---|
| 4,750,197 | A | 6/1988 | Denekamp et al. | |
| 8,297,494 | B1 | 10/2012 | Davis et al. | |
| 9,449,479 | B2 * | 9/2016 | Rogers | G08B 13/14 |
| 9,501,920 | B2 | 11/2016 | Harring et al. | |
| 9,980,020 | B1 | 5/2018 | Sharp et al. | |
| 10,074,247 | B1 | 9/2018 | Tang et al. | |

(Continued)

FOREIGN PATENT DOCUMENTS

| | | |
|---|---|---|
| JP | 2017-058802 | 3/2017 |
| KR | 10-2018-0105777 | 10/2018 |
| WO | 2015/132314 | 9/2015 |

OTHER PUBLICATIONS

"Multilevel alarm for a secure container", Novelty Search Report, Topic—B33027, Stellarix Consultancy Services, Jan. 31, 2019, 36 pages.

(Continued)

*Primary Examiner* — John A Tweel, Jr.
(74) *Attorney, Agent, or Firm* — Nixon & Vanderhye P.C.

(57) ABSTRACT

A secure container for storing a package, comprising: a lock for locking the container; a sensor for sensing that the secure container is unlocked; a transceiver for communicating with a telecommunications network; a controller configured, in response to the sensor sensing that the secure container is unlocked, to communicate, by means of the transceiver, an alert to a network device via the telecommunications network.

19 Claims, 3 Drawing Sheets

(56) References Cited

U.S. PATENT DOCUMENTS

Figure 1:
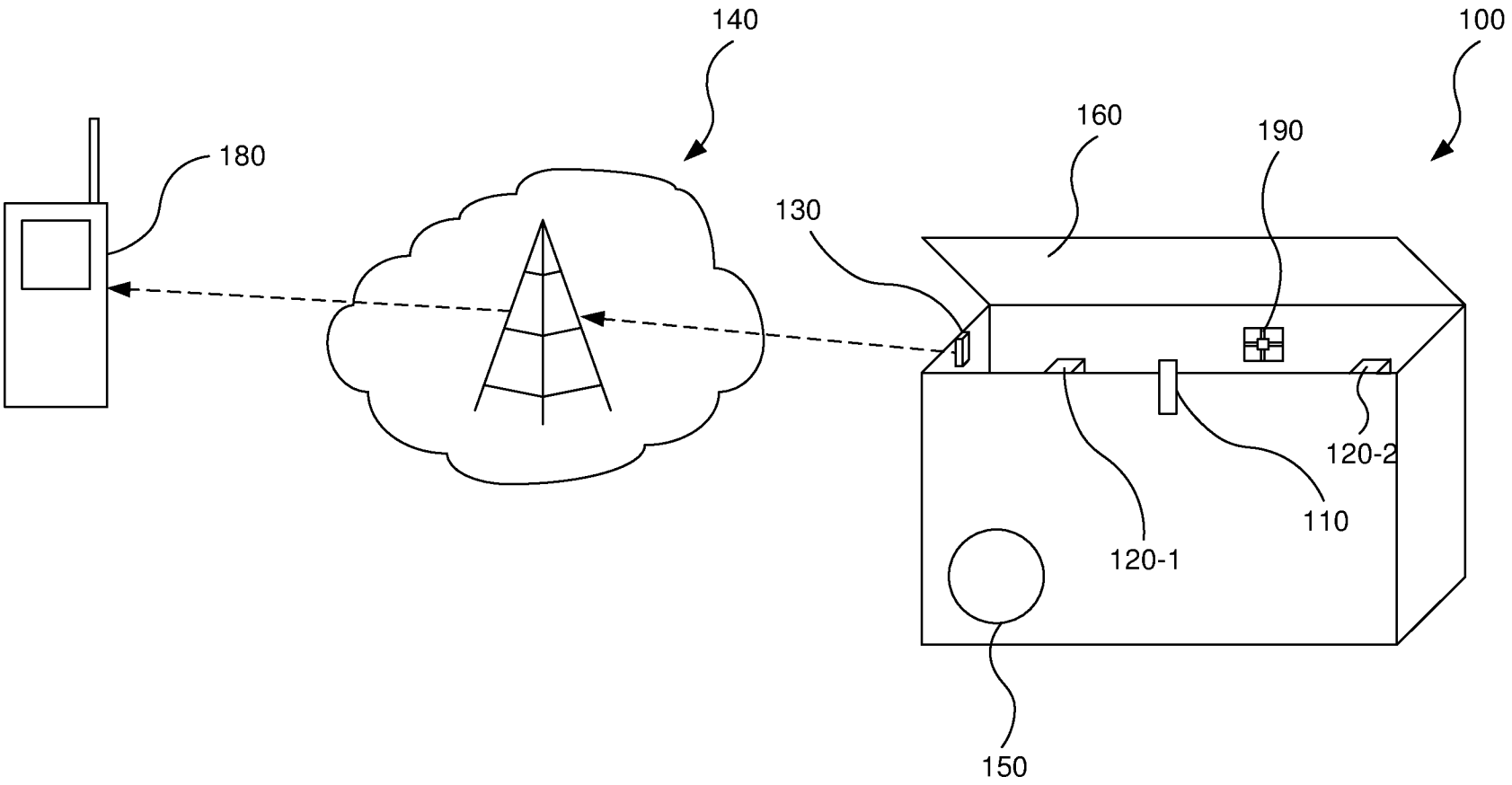

| | | | | |
|---|---|---|---|---|
| 10,984,617 | B2 * | 4/2021 | Wu | G07G 1/0018 |
| 2001/0045449 | A1 | 11/2001 | Shannon | |
| 2008/0040243 | A1 | 2/2008 | Chang et al. | |
| 2008/0258869 | A1 * | 10/2008 | Ognjenovic | G07C 9/00896 340/5.73 |
| 2017/0164773 | A1 | 6/2017 | Wirtz | |
| 2018/0029760 | A1 | 2/2018 | Maser | |
| 2018/0347232 | A1 | 12/2018 | Cordiner | |

OTHER PUBLICATIONS

Combined Search and Examination Report for GB Application No. 1904352.0 dated Sep. 30, 2019, 8 pages.
Extended European Search Report for EP Application No. 19165984.6 dated Oct. 7, 2019, 7 pages.
International Search Report for PCT/EP2020/057212 dated May 27, 2020, 5 pages.
Written Opinion of the ISA for PCT/EP2020/057212 dated May 27, 2020, 7 pages.

* cited by examiner

SECURED CONTAINER FOR STORING A PACKAGE

This application is the U.S. national phase of International Application No. PCT/EP2020/057212 filed Mar. 17, 2020 which designated the U.S. and claims priority to EP Patent Application No. 19165984.6 filed Mar. 28, 2019, the entire contents of each of which are hereby incorporated by reference.

FIELD OF INVENTION

The present invention relates to a secure container for storing a package, a method of operating a secure container, and to a system for operating a secure container.

BACKGROUND

Logistical service providers (such as couriers) may have the option of delivering a package to a secure container that is accessible both to the logistical service provider and to the intended recipient of the package (such as a consumer, for example a retail customer or a workman), but which prevents others from accessing the contents of the secure container.

However, the security of such secure containers is only as good as the trust in, and competence of, its users. Security will be compromised if the logistical service, or another legitimate user, (in)advertently does not secure the container.

It is an aim of the present invention to at least alleviate the aforementioned problem.

STATEMENTS OF INVENTION

According to a first aspect of the present invention, there is provided a secure container for storing a package, comprising: a lock for locking the container; a sensor for sensing that the secure container is unlocked; a transceiver for communicating with a telecommunications network; a controller configured, in response to the sensor sensing that the secure container is unlocked, to communicate, by means of the transceiver, an alert to a network device via the telecommunications network.

Preferably, the network device is remote to the secure container. Optionally, the network device is a server; a cellular telecommunications device; and/or a computer. Optionally, the network device hosts a user account. Optionally, the network device forwards the alert to a further network device.

Optionally, the telecommunications network comprises a wireless telecommunications network, and for example a cellular telecommunications network and/or a satellite telecommunications network. Optionally, the telecommunications network is a 2G cellular telecommunications network, and may be a 3G, 4G and/or 5G cellular telecommunications network.

Optionally, the alert is a notification and/or an instruction to trigger a notification and/or alarm at the network device. Optionally, the alert further comprises information uniquely identifying the secure container and/or providing a geographic location of the secure container.

Optionally, the secure container is battery-powered. Optionally, the secure container is a parcel store or safe. Optionally, the secure container is movable, in that it is not fixed. Optionally, the lock is a mechanical lock; and/or an electromagnetic lock.

Preferably, the secure container further comprises an alarm, wherein the controller is further configured to trigger the alarm in response to the sensor sensing that the secure container is unlocked. Preferably, the alarm is an audible and/or a visual alarm. Optionally, the alarm is remote, but proximate, to the secure container, and wherein the alarm is configured to be triggered by means of a wireless communication from the transceiver.

Preferably, the alert is communicated to the network device only after triggering said alarm. Alternatively, the alarm and the alert are simultaneously triggered, and more preferably only after a predetermined period of time. Preferably, the controller is configured to prevent communication of the alert to the network device in dependence on the sensor sensing that the container is subsequently locked prior to communicating the alert.

Preferably, the secure container further comprises a closure for closing the secure container; a further sensor for sensing that the secure container is closed by means of the closure; and wherein the controller is further configured to communicate, by means of the transceiver, the alert to the network device in response to the further sensor sensing that the closure is open.

Preferably, the lock is for locking the closure so as to lock the secure container closed. Optionally, the closure is in the form of a: lid; door; cover; shutter; cap or plug. Optionally, the sensor and/or the further sensor is/are in the form of: a pressure sensor; contact sensor; proximity sensor; a micro switch; a light/optical sensor; a magnetic field sensor; and/or an electric, magnetic or mechanical switch.

Optionally, the alarm is only triggered and/or the alert is only communicated if the sensor and/or the further sensor sense/s that the secure container is not locked and/or that the closure is open for a predetermined period of time. Optionally, said predetermined time is different for triggering the alarm to that for triggering the alert.

Preferably, the controller is further configured to trigger the alarm in response to the further sensor sensing that the closure is open. Preferably, the alarm is ceased once the secure container has been locked and/or the closure has been closed. Preferably, a further alert is sent to the network device once the secure container has been locked and/or the closure has been closed.

Preferably, the controller is configured to detect authorised use of the secure container. As used herein, the term "authorised" in the context of the secure container preferably connotes use in a way that is indicative of legitimate use of the secure container and/or by an individual that has, or is expected to have, permission to use the secure container, and more preferably also at a time when such permission subsists, and therefore authorised use excludes forced entry and malicious interference (e.g. vandalism), and therefore excludes opening in a manner other than by virtue of unlocking the secure container in a predetermined manner. Furthermore, as used herein, the term "use" in the context of "authorised use", preferably connotes unlocking or opening or otherwise accessing the secure container.

Preferably, the secure container is configured to communicate the alert in dependence on detecting authorised use of the secure container, and more preferably only in dependence on detecting such authorised use.

Preferably, the secure container is configured to trigger the alarm in dependence on detecting authorised use of the secure container, and only in dependence on detecting such authorised use. Optionally, the secure container is configured only to communicate the alert and/or the alarm in dependence on having detected authorised use of the secure container. Preferably, authorised use is detected in dependence on: a schedule specifying periods of authorised use; receiving a valid identifier; and/or an absence of a detection of malicious interference by an interference sensor of the secure container.

Optionally, the schedule is predefined and/or updated by means of a communication received by the transceiver. Optionally, the identifier is received by the secure container by means of an input device. Optionally, the input device is a: keypad; reader and/or a sensor.

Optionally the input device is a: RFID reader; biometric sensor; a camera; an optical reader for a barcode and/or a QR code; a magnetic sensor; the, or a further, transceiver; and/or the, or a further, network device and the transceiver.

Optionally the identifier is: a passcode (e.g. a password, a Personal Identification Number (PIN), and/or any (intended) secret alphabetical, numerical and/or alphanumerical character string); a one-time authentication certificate and/or token; and/or biometric information.

Optionally, the interference sensor is in the form of a: vibration detector; force detector; location detector; breach detector; temperature detector; and/or a detector for detecting a malicious network communication. Preferably, the controller is configured to identify an authorised user of the secure container. Optionally, the authorised user is an intended recipient of a package deposited (or expected to be, or to have been, deposited). Optionally, the authorised user is uniquely identified.

Optionally, the controller is configured to receive identity information so as to identify the authorised user by means of the, or a further, input device. Optionally, the identity information is the, or a further, identifier. Optionally, the authorised use is identified in dependence upon identifying the authorised user. Optionally, the authorised user is identified in dependence upon detecting authorised use.

Optionally, the authorised use and the authorised user are identified by the same means, and may be identified by the same identifier. Optionally, the identifier, or the further identifier, is generated by the telecommunications network or the, or the further, network device. Optionally, the lock is configured to unlock upon detecting the authorised use and/or upon identifying the authorised user.

Optionally, the secure container is configured to trigger the alarm and/or to communicate the alert (and optionally only when) having identified the authorised user. Optionally, the identified authorised user is the most recent identified authorised user. Optionally, the identified authorised user is a future expected authorised user.

Optionally, the identified authorised user is an authorised user that is sensed as being proximate to the secure container, and said sensing may be performed by: the telecommunications network, the secure container; and/or the network device. Preferably, the alert comprises information identifying the identified authorised user.

Preferably, the controller (or the remote device and/or the telecommunication network) is further configured to identify the network device in dependence on the identified authorised user. Optionally, the network device is (optionally, uniquely) associated with the identified authorised user.

Optionally, there is provided a table associating the identified authorised user and the network device, the table may be provided as part of: the secure container; the telecommunications network (and in particular a core of the network); and/or the, or another, network device (for example, a server).

Optionally, the table is populated so as to associate the identified authorised user and the network device as part of a process for a user to be registered as the authorised user.

Optionally, identifying the network device comprises identifying a network address of the network device, and wherein said network address may be a: mobile telephone number; an IMSI and/or IMEI; a data network address (e.g. a URL, a MAC and/or an IP address; a user account; and/or an email address).

Optionally, the identifier for identifying the authorised use and/or the identifier, or the further identifier, for identifying the authorised user comprises the, or is derived from, the network address of the network device.

According to another aspect of the invention, there is provided a method of operating a secure container, the secure container being configured to communicate with telecommunications network, comprising the steps of: sensing that the secure container is unlocked; and in response to the sensing that the container is unlocked, communicating an alert to a network device via the telecommunications network. Optionally, the method further comprises steps as performed by a secure container as described above.

According to yet another aspect of the invention, there is provided a system for operating a secure container, comprising: a secure container as described above; and the telecommunications network as described above. Optionally, the system further comprises the network device.

The invention extends to any novel aspects or features described and/or illustrated herein. The invention extends to methods and/or apparatus substantially as herein described and/or as illustrated with reference to the accompanying drawings. The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

Any apparatus feature as described herein may also be provided as a method feature, and vice versa. As used herein, means plus function features may be expressed alternatively in terms of their corresponding structure, such as a suitably programmed controller 190 and associated memory.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination. It should also be appreciated that particular combinations of the various features described and defined in any aspects of the invention can be implemented and/or supplied and/or used independently.

In this specification the word 'or' can be interpreted in the exclusive or inclusive sense unless stated otherwise. Furthermore, features implemented in hardware may generally be implemented in software, and vice versa. Any reference to software and hardware features herein should be construed accordingly.

Figure 2:
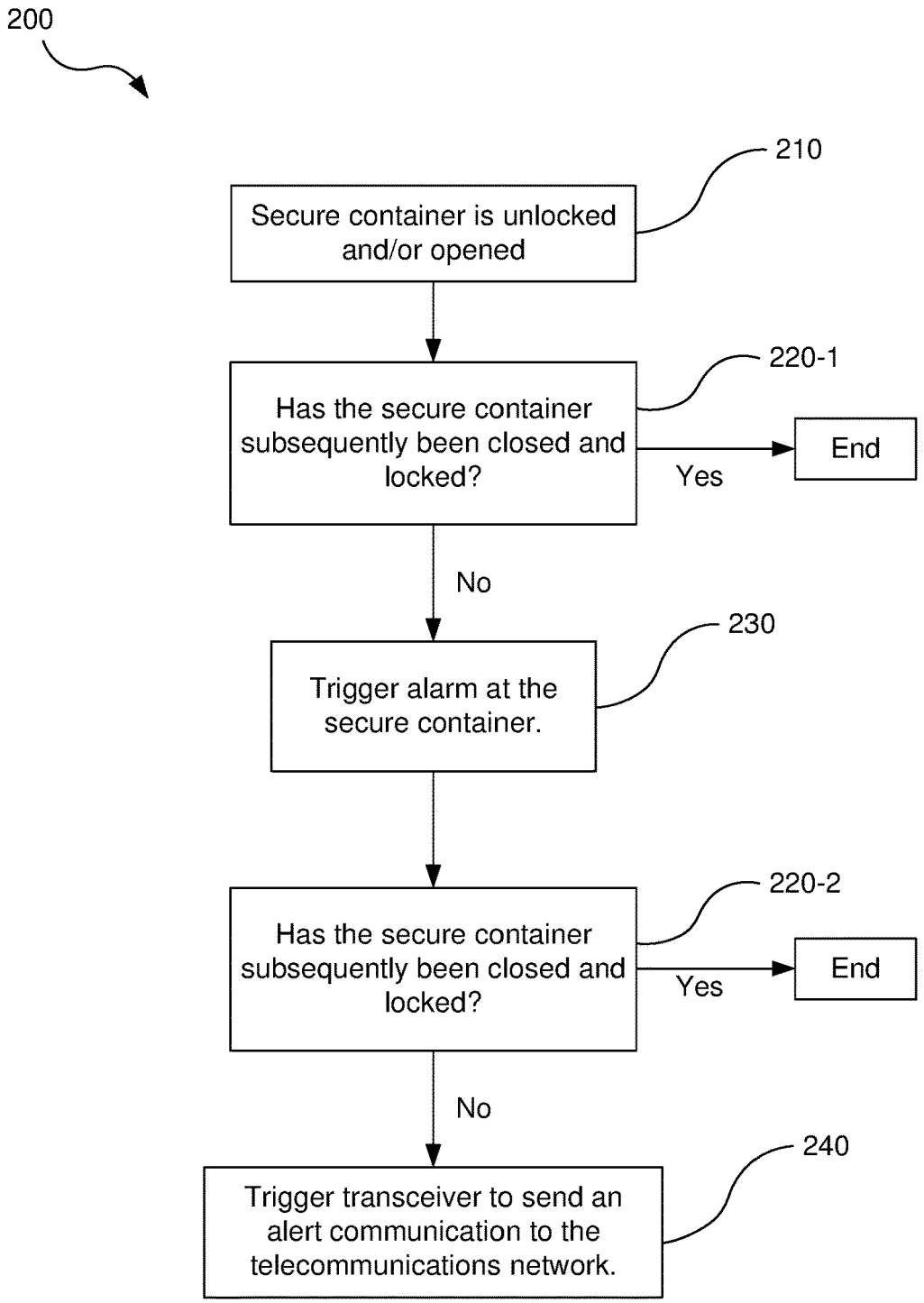
Figure 3:
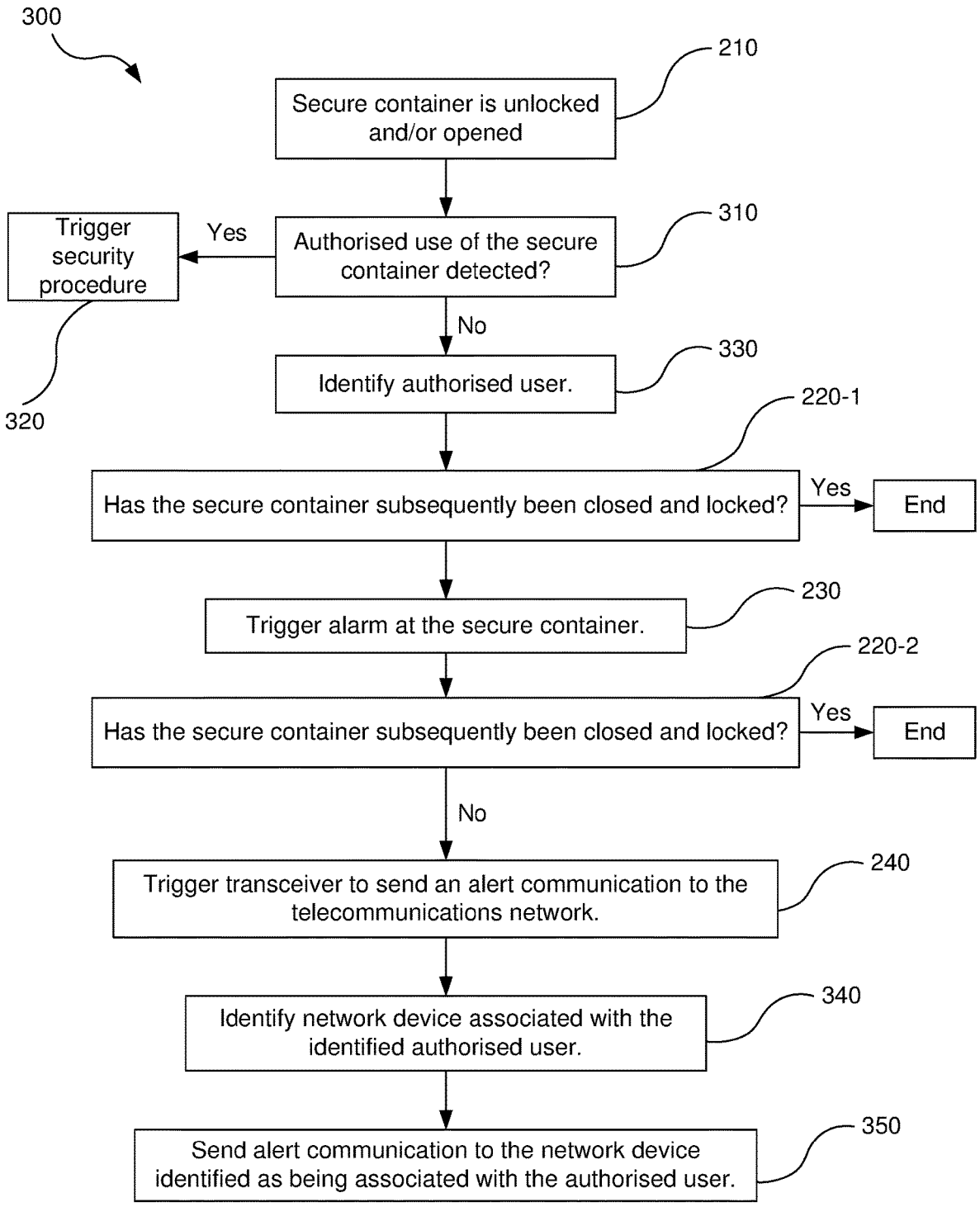

The invention extends to a secure container, a method of operating a secure container and a system for operating a secure container as described herein and/or substantially as illustrated with reference to the accompanying drawings. The present invention is now described, purely by way of example, with reference to the accompanying diagrammatic drawings, in which:

FIG. 1 shows a secure container and a system comprising the secure container; and FIGS. 2 and 3 show processes of operating the secure container.

SPECIFIC DESCRIPTION

FIG. 1 shows a secure container 100 comprising: a lock 110 for locking the secure container; sensors 120 for sensing the secureness of the secure container; a transceiver 130 for communicating with a telecommunications network 140; and an alarm 150 (e.g. in the form of an audible and/or visual alarm).

The secure container 100 is formed so as to define a chamber for receiving a package, and the secure container has any appropriate dimensions so as to receive within the chamber at least one package.

The secure container 100 further comprises a closure 160 (shown in the form of a hinged lid) for sealing the chamber. As a result, the closure 160 may be shut and the lock 110 may be actuated so as to secure the closure in a shut position thereby securely to contain a package within the chamber of the secure container.

In turn, the sensors 120 comprise a lock sensor 120-1 and a closure sensor 120-2 for sensing whether the closure 160 is locked by means of the lock 110 and whether the closure 160 is shut, respectively.

The secure container 100 further comprises a controller 190 for controlling the transceiver 130 and the alarm 150, and for receiving and processing inputs from the sensors 120. The controller 190 is further configured to receive instructions from a user so as to set up the secure container for use.

Accordingly, in dependence on the controller 190 receiving an input from the lock sensor 120-1 and/or the closure sensor 120-2 that the secure container is not locked and/or not closed, respectively, the controller 190 is configured to:

- trigger the alarm 150; and/or
- cause the transceiver 130 to generate an alert communication to the telecommunications network 140.

The alert communication generated by the transceiver 130 is configured to be communicated by the telecommunications network 140 to a network device 180. In one example, the network device 180 is a mobile telecommunications device 180. In another example, the network device is a server, and the server is available to host an application and/or a user account.

FIGS. 2 and 3 show processes for operating the secure container 100.

FIG. 2 shows an overview of a process 200 for operating the secure container 100. Accordingly, in a first step 210, the secure container senses that it has been unlocked and/or opened, as sensed by the sensors (as appropriate) and processed by the controller 190.

In a next step 220-1, the controller 190 performs a query as to whether the secure container has subsequently been closed and locked 220.

Step 220-1 is triggered, for example, by:

- a timer, configured to run step 220 after a predetermined delay; and/or
- an event, such as:
  - detecting (by means of a further appropriate sensor, not shown, such as a weight sensor or an optical sensor) the removal or addition of a package from within the secure container; and/or
  - sensing that the closure has been closed, but not locked (within a pre-determined period of time).

If at step 220-1 it is determined that the secure container 100 has not been closed and locked, then the controller 190 triggers the alarm 230. In this way, a user proximate to the secure container may be alerted to the fact that the secure container has not been locked and/or closed, thereby to prompt the user to take remedial action. In a next step 220-2, the controller 190 performs a further instance of query 220 so as to assess whether the secure container 100 has been closed and locked having triggered the alarm for a predetermined period of time.

If at step 220-2 it is determined that the secure container still has not been locked and closed, then the controller 190 triggers 240 the transceiver 130 to transmit the alert communication to the telecommunications network 140 and on to a network device 180. In this way, a user associated with the network device 180 may be alerted that the secure container 100 is unsecure, and may therefore take remedial action so as to secure the container.

If, however, at steps 220-1 or 220-2 it is determined that the secure container 100 has been locked and closed, then process 200 ends, since it is sensed that the secure container has been made secure.

In a further example, the secure container, by means of the controller 190, is configured to identify authorised use of the secure container.

Authorised use of the secure container is use (past, present or anticipated) by an authorised user, and where an authorised user has permission to use the secure container (in an appropriate way and/or at an appropriate time).

The controller 190 is therefore configured to detect authorised use (either definitively or by inference) and/or uniquely to identify the authorised user; this is performed, for example, by:

- a sensor for sensing malicious interference with the secure container (not shown) not having been triggered, where examples of such a sensor include:
  - a vibration and/or force sensor, such that excessive vibration and/or force may be indicative of malicious use (e.g. forced entry);
  - a location sensor, where excessive geographical movement of the secure container may be indicative of malicious use (e.g. theft);
  - a breach sensor, such as a light and/or IR sensor within the chamber;
  - a temperature sensor, where excessive heat or cold may be indicative of forced entry; and/or
  - a sensor for sensing malicious network communications (for example, appropriate where the lock 110 is available to be unlocked by means of a network communication received by the transceiver 130).
- sensing unlocking and/or opening of the secure container at a time (e.g. time of day and/or a date) during which authorised use is scheduled, such authorised use may be scheduled according to:
  - pre-specified times (e.g. weekdays and during working hours only), in which:
    - the pre-specified times are accessible by the controller 190, for example as part of memory associated with the controller; and/or the pre-specified times are available to be updated, for example by receiving at the transceiver 130 a network communication from the telecommunications network 140 updating the pre-specified times;

a booking schedule, in which authorised users of the secure container are available to book a time slot within which to access the secure container 100, in which:

a successful booking is communicated to the secure container 100 by means of the telecommunications network 140, as received by the transceiver 130 and stored by the controller 190; and/or booking is available to be performed by means of the network device 180, and for example using an application to which a user identity is input (e.g. via login details associated with a user account).

and/or receiving an identifier indicative of an authorised user, in which the identifier is:

biometric information, such as fingerprint, voice and/or face recognition;

a passcode, such as a Personal Identification Number (PIN) or password;

an authentication certificate or token, for example communicated by the, or another, network device 180 to the secure container;

an identifier stored as part of a barcode, QR code, magnetic strip and/or RFID tag; and/or read by a reader (not shown), for example a reader for reading any of the aforementioned identifiers, in which the reader is provided as part of the:

secure container 100; and/or the, or another, network device 180 that is capable of communicating the identifier (and/or a determination that the identifier is indicative of an authorised user) to the secure container (e.g. by means of the telecommunications network 140 and/or a local area network, such as a WiFi™ or Bluetooth™ network).

In some examples (in particular where an identifier is used), detecting authorised use also permits the controller 190 to unlock the secure controller and/or to prevent unlocking and/or opening of the secure container where malicious use is detected.

In a further example, FIG. 3 shows process 300 of operating the secure container 100 so as to trigger the alarm 150 and/or transmission of the alert communication thereby to prompt a user/s to rectify an unsecured state of the secure container 100.

As per process 200, in a first step the secure container 100 is sensed as having been unlocked and/opened 210 by means of the sensors 120. Next, the controller 190 assesses whether the unlocking and/or opening sensed in step 210 constitutes authorised use 310 (for example, as described above). For example, the secure container 100 receives (e.g. by means of a keypad, not shown, associated with the secure container) a one-time token that permits the lock to be unlocked and that indicates authorised use. For example, the token is generated by the network device 180, which is in the form of a server for managing the secure container, and communicated to another network device (not shown) in the form of a mobile telephone (which is associated in the server with an authorised user) and communicated to the secure container by means of the telecommunications network 140.

If a determination is made that the use of the secure container that is not authorised, a determination is made that the use is malicious interference, in which case the secure container 100 is available to trigger a security procedure 320, which includes, for example:

alerting, by means of the transceiver 130, security services (e.g. police), in which said alerting includes a location and/or a unique identifier associated with the security container 100;

preventing future unlocking and/or opening of the secure container 100 (until this status is reset);

triggering a surveillance system, for example a security camera (not shown) provided as part of the secure container and/or as part of a remote system (whereby the security camera is triggered by a communication from the transceiver 130, for example over the telecommunications network 140); and/or triggering the alarm 150.

If, however, the controller 190 identifies authorised use, then the controller is available to identify, or infer the identity of, the authorised user at a next step 330, by, for example, the same means that identified the authorised use (e.g. the identifier and/or use of the secure container at a time associated with a booking) and/or by receiving further identity information.

Process 300 then proceeds as per steps 220-1, 230 and 220-2, 240 which are performed as described with reference to FIG. 2.

Following step 240, in which the secure container 100 triggers the transceiver 130 to transmit the alert communication to the telecommunications network 140, the network device 180 to which to forward the alert communication is identified at a next step 340. The identity of the network device 180 is derived from the identity of the authorised user that was identified at step 330 based on a predefined association between the two.

The identified authorised user is associated with the network device 180 as part of a booking made in the booking schedule by the identified authorised user and/or the identifier for uniquely identifying the authorised user (e.g. as described above). The identity of the network device 180 is available to be a network address that permits the telecommunications network 140 in turn to communicate with the network device, and is for example: a mobile telephone number; a cellular network subscriber identity; an email address; and/or a user account.

Identification of the network device 340 is performed, for example, by the telecommunications network 140 and/or by an identification server (not shown) that is in communication with the telecommunications network 140. The identification server is available to provide the booking schedule and/or the user account associated with a secure container.

Once the network device has been identified 340, the identity of the network device is communicated to the telecommunications network 140 so as to cause transmission of the alert communication to the identified network device 180 identified as being associated with the identified authorised user 350.

In this way, the process of prompting a legitimate user as to an unsecure state of the secure container is made following authorised use of the secure container, and to a user that is most likely for having caused the unsecure state of the secure container.

In one example, the controller 190 is configured to trigger the alarm and/or the alert communication only when authorised use of the secure container is detected.

The telecommunications network 140 is available to be any form of telecommunications network, including a wide area network (e.g. a cellular network or a satellite network) or a local area network (e.g. a Wi-Fi or Bluetooth network).

In particular the telecommunications network operates in accordance with 2G, 3G, 4G and/or 5G cellular technology. Advantageously, a 2G cellular telecommunications network provides an energy-efficient means of communicating small amount of data (i.e. an alert communication) at irregular intervals (i.e. as and when it is triggered). The telecommunications network is available to interconnect with other networks, including private networks and/or the Internet.

The alert communication is available to comprise:

a timestamp;

instructions (human- and/or machine-readable);

a unique identifier for identifying the secure container that triggered the alert communication; and/or a geographic location of the secure container that triggered the alert communication.

The secure container is available to be battery-powered, mains powered and/or comprises an energy source (e.g. a solar panel).

ALTERNATIVES AND MODIFICATIONS

In one alternative the secure container 100 is in the form of a locker, and the closure 160 is a door or shutter.

The secure container 100 is available to be provided as part of a batch of secure containers that are together integrally formed and/or that are functionally interconnected so as to share certain of the aforementioned components of the secure container 100 (for example, as best shown in, and described with reference to, FIG. 1), such as the controller 190, the alarm 150 and/or the transceiver 130.

With reference to FIG. 3, if the identity of the authorised user cannot be determined (e.g. at step 330), if an associated network device cannot be identified (e.g. at step 340) and/or if the secure container still has not been made secure having (after a predetermined period of time) sent the alert communication (e.g. at step 350), then a further alert communication is available to be sent by the transceiver 130, the network device 180 and/or the telecommunications network 140 (as appropriate) to:

a predefined owner of the secure container;

a predefined intended recipient of a package that has (or was expected to have been) deposited in the secure container (associated with an authorised user or secure container, for example, by means of a predefined booking);

another authorised user that had previously used (with authorisation) the secure container; and/or an authorised user that is nearby to the secure container, for example by:

broadcasting the alert communication as a secure local area communication; and/or the telecommunications network identifying such nearby authorised users, for example by means of cell tower triangulation;

and/or an expected future authorised user of the secure container (such as an authorised user that has made a future booking to use the secure container).

In yet another example, the alarm and/or the alert communication are configured to be triggered in response to sensing that a user (or an authorised user) has failed to deposit or to collect a package (in particular the correct package) from the secure container; this is performed, for example, by the sensors 120, where the sensors 120 also comprise, for example, a weight sensor and/or an identification sensor (such as an optical sensor for reading a barcode associated with a package and/or an RFID reader for reading an RF tag associated with a package).

Each feature disclosed in the description, and (where appropriate) the claims and drawings may be provided independently or in any appropriate combination.

Reference numerals appearing in the claims are by way of illustration only and shall have no limiting effect on the scope of the claims.

The invention claimed is:

1. A secure container for storing a package, comprising:

a lock for locking the container;

a sensor for sensing that the secure container is unlocked;

a transceiver for communicating with a telecommunications network;

a controller configured, in response to the sensor sensing that the secure container is unlocked, to communicate, by means of the transceiver, an alert to a network device via the telecommunications network; and an alarm, wherein:

the controller is further configured to trigger the alarm in response to the sensor sensing that the secure container is unlocked;

the alert is communicated to the network device only after triggering the alarm; and the controller is configured to prevent communication of the alert to the network device in dependence on the sensor sensing that the container is subsequently locked prior to communicating the alert.

2. A secure container according to claim 1, further comprising:

a closure for closing the secure container;

a further sensor for sensing that the secure container is closed by means of the closure; and wherein the controller is further configured to communicate, by means of the transceiver, the alert to the network device in response to the further sensor sensing that the closure is open.

3. A secure container according to claim 2, wherein the controller is further configured to trigger the alarm in response to the further sensor sensing that the closure is open.

4. A secure container according to claim 1, wherein the controller is configured to detect authorised use of the secure container.

5. A secure container according to claim 4, wherein the secure container is configured to communicate the alert in dependence on detecting authorised use of the secure container.

6. A secure container according to claim 4, wherein the secure container is configured to trigger the alarm in dependence on detecting authorised use of the secure container.

7. A secure container according to claim 4, wherein authorised use is detected in dependence on: a schedule specifying periods of authorised use; receiving a valid identifier; and/or an absence of a detection of malicious interference by an interference sensor of the secure container.

8. A secure container according to claim 1, wherein the controller is configured to identify an authorised user of the secure container.

9. A secure container according to claim 8, wherein the alert comprises information identifying the identified authorised user.

10. A secure container according to claim 8, wherein the controller is further configured to identify the network device in dependence on the identified authorised user.

11. A system for operating a secure container, comprising:

a secure container according to claim 1; and a telecommunications network.

12. A method of operating a secure container for storing a package, the secure container comprising an alarm and being configured to communicate with a network device via a telecommunications network, and the secure container comprising a lock for locking the secure container and a lock sensor for sensing that the lock is unlocked, the method comprising the steps of:

sensing, via the lock sensor, that the secure container is unlocked;

in response to sensing that the container is unlocked, the secure container;

triggering the alarm;

subsequently communicating an alert to the network device via the telecommunications network only after triggering said alarm; and preventing communication of the alert to the network device in dependence on the sensor sensing that the container is subsequently locked prior to communicating the alert.

13. The method according to claim 12, further comprising:

closing the secure container using a closure;

sensing that the secure container is closed; and communicating the alert to the network device in response to sensing that the closure is open.

14. The method according to claim 13, further comprising triggering the alarm in response to the sensing that the closure is open.

15. The method according to claim 12, further comprising:

detecting authorised use of the secure container; and communicating the alert or triggering the alarm in dependence on the detection of the authorised use of the secure container.

16. The method according to claim 15, further comprising detecting authorised use of the secure container in dependence on: a schedule specifying periods of authorised use; receiving a valid identifier; and/or an absence of a detection of malicious interference by an interference sensor of the secure container.

17. The method according to claim 12, further comprising identifying an authorised user of the secure container.

18. The method according to claim 17, wherein the alert comprises information identifying the identified authorised user.

19. The method according to claim 17, further comprising identifying the network device in dependence on the identified authorised user.

* * * * *